US005172911A

United States Patent [19]

Chang

[11] Patent Number: 5,172,911

[45] Date of Patent: Dec. 22, 1992

[54] METAL RACKET FRAME

[76] Inventor: Chen-Chung Chang, No. 912, Chung-Shang Rd., Shen-Kong Hsiang, Taichung Hsien, Taiwan

[21] Appl. No.: 815,487

[22] Filed: Dec. 31, 1991

[51] Int. Cl.[5] ..... A63B 49/12

[52] U.S. Cl. ..... 273/73 H; 273/73 G

[58] Field of Search ..... 273/73 R, 73 C, 73 D, 273/73 G, 73 H

[56] References Cited

U.S. PATENT DOCUMENTS

| | | | |
|---|---|---|---|
| 4,166,616 | 9/1979 | Kohzu | 273/73 G |
| 4,278,251 | 7/1981 | Lafourcade | 273/73 G |
| 4,282,642 | 8/1981 | Rodgers, Jr. | 273/73 H X |
| 4,290,604 | 9/1981 | Field | 273/73 G |
| 4,331,331 | 5/1982 | Rodgers, Jr. | 273/73 G X |

*Primary Examiner*—V. Millin
*Assistant Examiner*—Raleigh W. Chiu
*Attorney, Agent, or Firm*—Christensen, O'Connor, Johnson & Kindness

[57] ABSTRACT

A metal racket frame includes a metal tube which is bent so as to form a curved head portion, a converging throat portion which extends from the head portion and a handle portion which extends from the throat portion. The metal tube is provided with a pair of spaced elongated partitions which extend along the length of the same. The partitions confine a central space therebetween and a side space on each side of the central space. The throat portion has two branches, each of which is formed with at least one elongated cut-out portion to access one of the side spaces. A bridge portion extends between the branches of the throat portion and cooperates with the head portion to define an oval-shaped, web holding structure. A plastic coating covers the metal tube and has an engaging projection received in each cut-out portion. The bridge portion, the engaging projection and the plastic coating are made of a fiber-reinforced composite material and are simultaneously and integrally formed in a mold after placing the metal tube therein.

6 Claims, 8 Drawing Sheets

METAL RACKET FRAME

BACKGROUND OF THE INVENTION

1. Field of the Invention

The invention relates to a metal racket frame, more particularly to a metal racket frame which is more stable and durable than that of the prior art.

2. Description of the Related Art

Referring to FIG. 1, a conventional metal racket frame is shown to comprise a metal shaft (1) which is bent to form a curved head portion, a converging throat portion which extends from the head portion and a handle portion which extends from the throat portion. A plastic bridge portion (2) is secured on the throat portion of the metal shaft (1) by means of bolts (3) (only one bolt is shown).

Note that a web of strings secured on the conventional metal racket frame tends to pull the bridge portion (2) to disengage the metal shaft (1) [the pulling forces are indicated by the arrows (A) and (B)]. This condition is worsened when the web is struck. The resulting vibrations can loosen the bolts (3) and thereby easily move the bridge portion (2) from its original position.

Note also that the resulting vibrations make it relatively difficult to handle the conventional metal racket frame properly when the metal racket frame is struck.

SUMMARY OF THE INVENTION

Therefore, the objective of the present invention is to provide a metal racket frame which is more stable and durable than that of the prior art.

More specifically, the main objective of the present invention is to provide a metal racket frame which has a bridge portion that is integral with the throat portion of the racket frame.

Another objective of the present invention is to provide a metal racket frame with a vibration-absorbing member disposed adjacent to the handle portion of the racket frame so as to facilitate proper handling of the racket frame when the metal racket frame is struck.

Accordingly, the preferred embodiment of a metal racket frame of the present invention comprises:

a metal tube which is bent to form a curved head portion, a converging throat portion which extends from the head portion and a handle portion which extends from the throat portion; said metal tube being provided with a pair of spaced elongated partitions which extend along the length of the same; said partitions confining a central space therebetween and a side space on each side of the central space; said throat portion having two branches, each of which are formed with at least one elongated cut-out portion to access one of the side spaces;

a plurality of sealing members, each of which is provided inside one of the side spaces accessed by the cut-out portion adjacent to one end of the cut-out portion; and a bridge portion which extends between the branches of the throat portion and which cooperates with the head portion to define an oval-shaped web holding structure, a plastic coating covering the metal tube and having an engaging projection received in each cut-out portion; said bridge portion, said engaging projection and said plastic coating being made of a fiber-reinforced composite material and being simultaneously and integrally formed in a mold after placing the metal tube therein.

A vibration-absorbing member is provided in a gap defined by the branches of the throat portion at a location adjacent to the handle portion. The vibration-absorbing member is made of rubber and has a pair of contact surfaces which are in tight pressing contact with the branches of the throat portion. A rivet means is further provided to retain the vibration-absorbing member between the branches of the throat portion.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
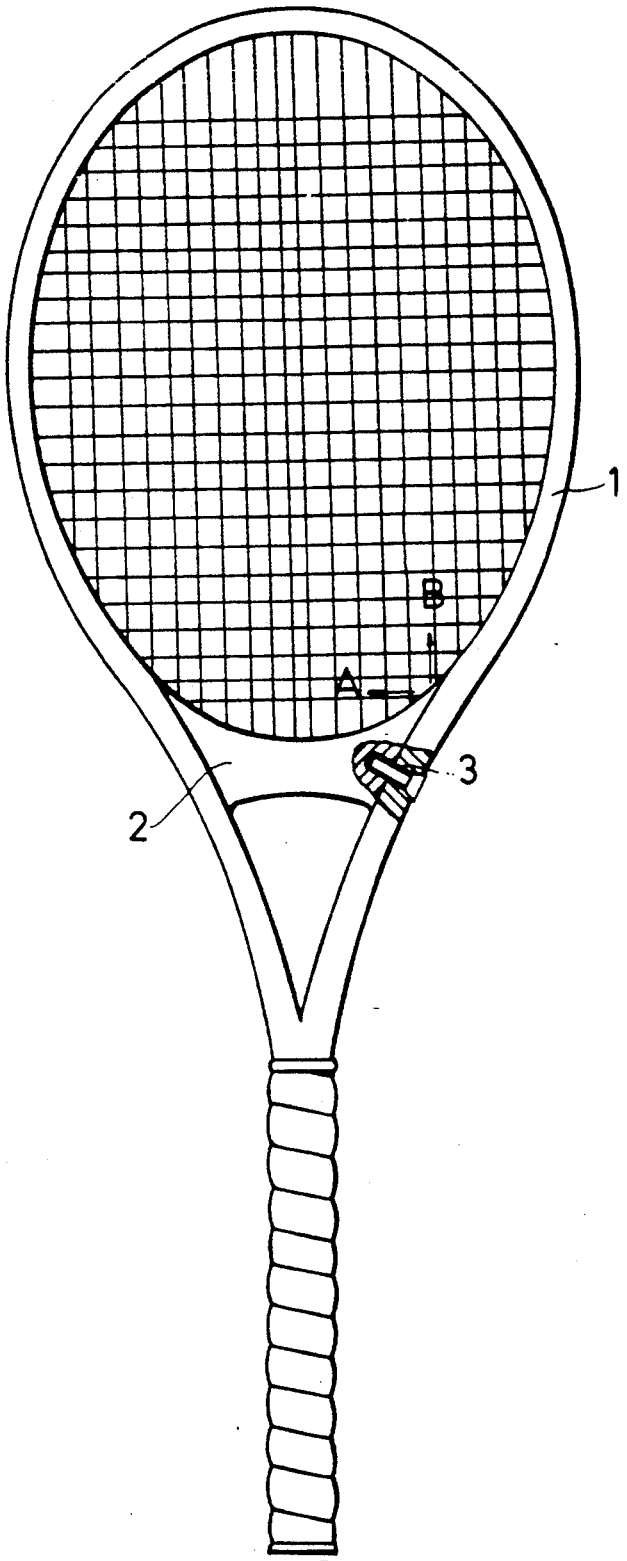
FIG. 1 PRIOR ART
FIG. 1 is an illustration of a conventional metal racket frame.
Figure 2:
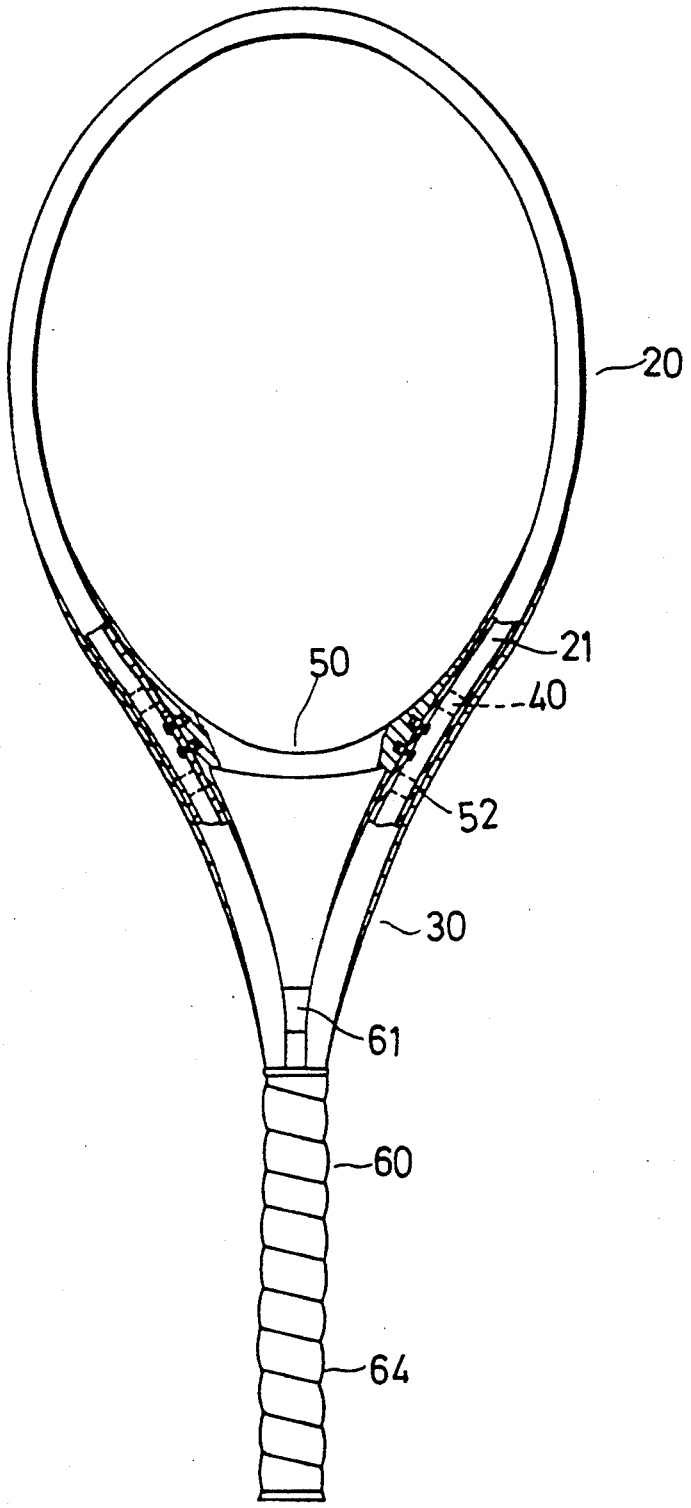
FIG. 2 is an illustration of the preferred embodiment of a metal racket frame according to the present invention.
Figure 3:
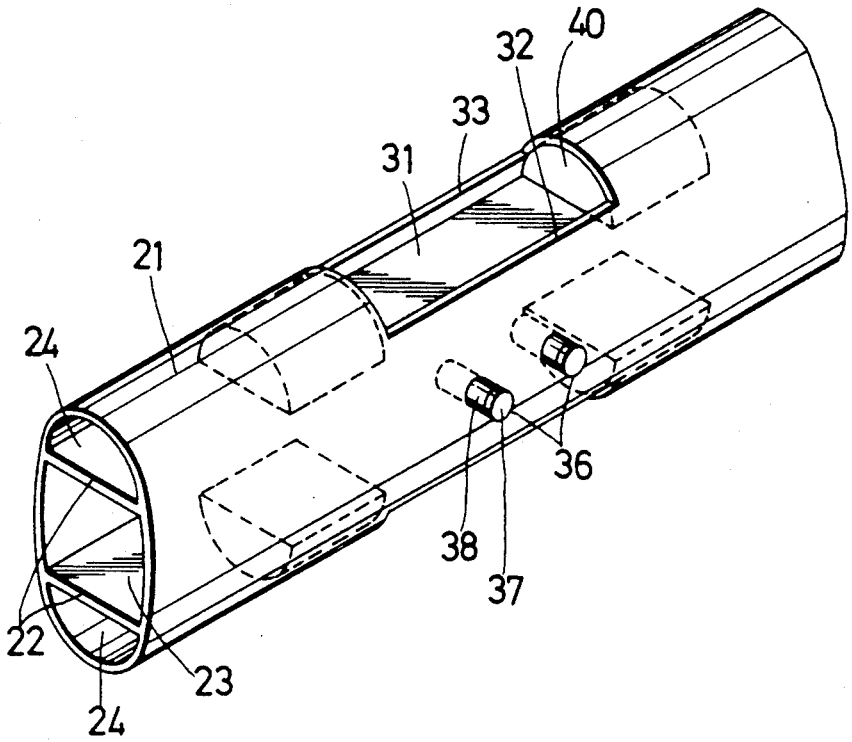
FIG. 3 is an illustration of one branch of the throat portion of the metal racket frame of the preferred embodiment.
Figure 4:
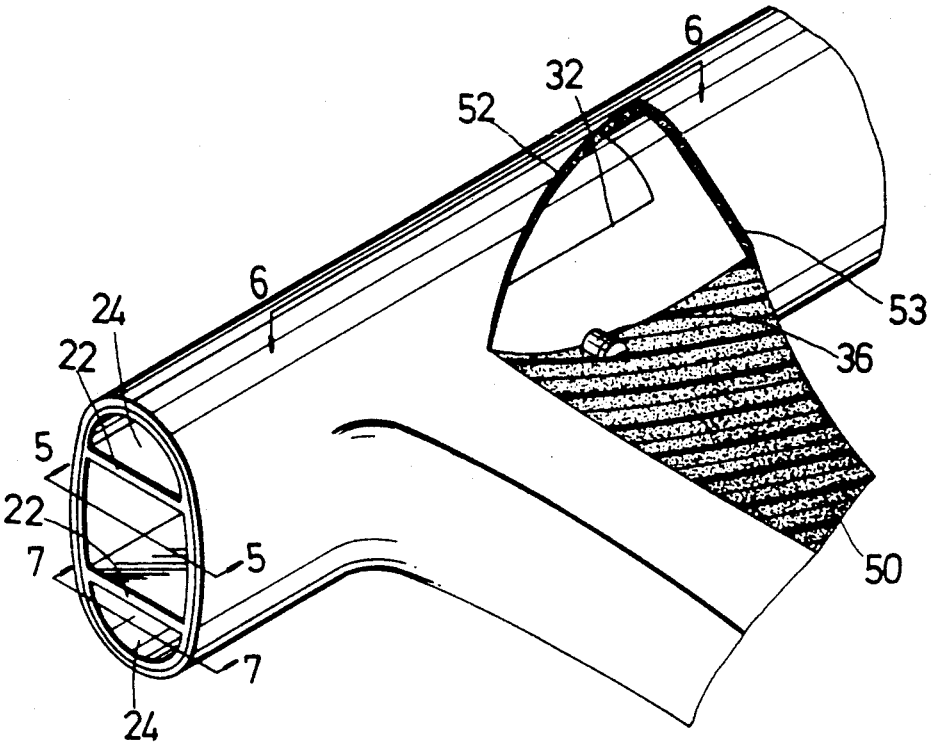
FIG. 4 is a fragmentary view illustrating the assembly of a bridge portion of the preferred embodiment to the throat portion of the metal racket frame of the present invention.

Referring to FIGS. 2 and 3, the preferred embodiment of a metal racket frame according to the present invention is shown to comprise: a metal tube (21) which is bent so as to form a curved head portion (20), a converging throat portion (30) which extends from the head portion (20) and a handle portion (60) which extends from the throat portion (30); a plurality of sealing members (40); and a bridge portion (50).

The metal tube (21) is oblong in cross section and is provided with a pair of spaced elongated partitions (22) which extend along the length of the metal tube (21). The partitions (22) confine a central space (23) therebetween and a side space (24) on each side of the central space (23).

Figure 5:
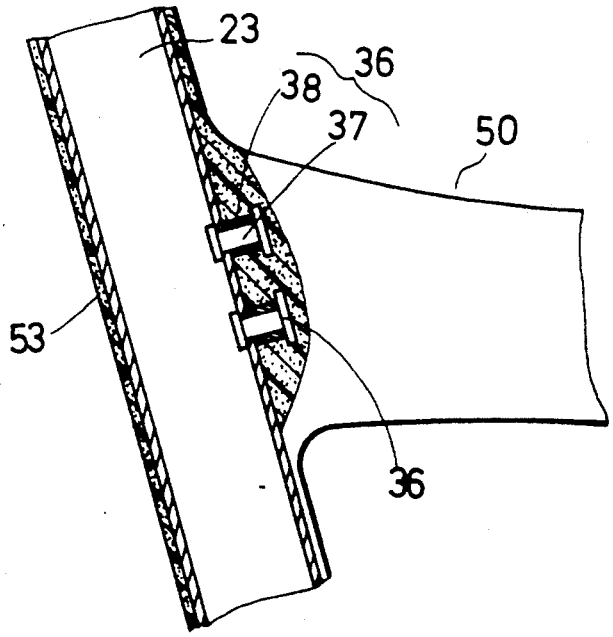
FIG. 5 is a 5—5 section of FIG. 4.
Figure 6:
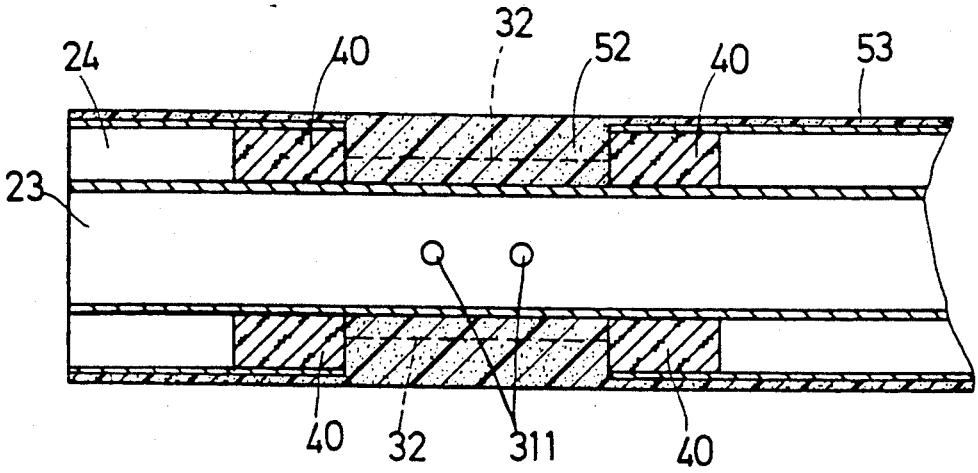
FIG. 6 is a 6—6 section of FIG. 4.
Figure 7:
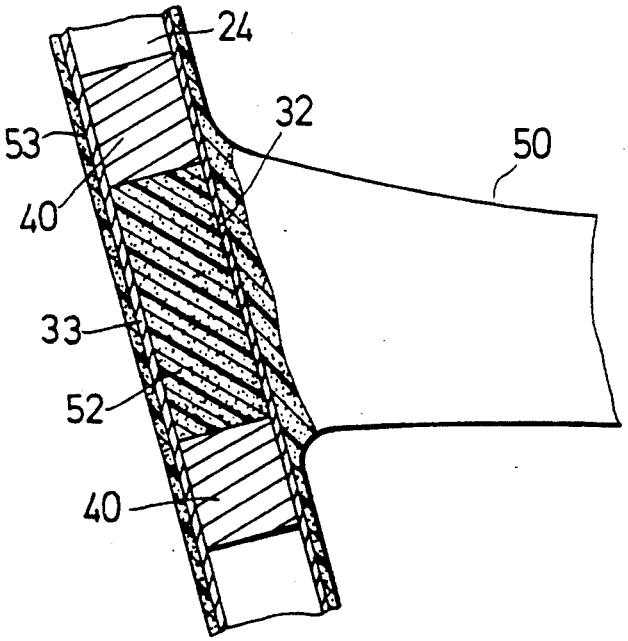
FIG. 7 is a 7—7 section of FIG. 4.

Referring to FIGS. 3, 5 and 6, the metal tube (2I) is provided with a pair of elongated cut-out portions (31) at each branch of the throat portion (30) to access the side spaces (24). Each of the cut-out portions (31) is defined by a pair of curved side walls (32, 33) which extend from two edges of the partitions (22). Two studs (36) are provided on an inner side of the metal tube (21) at each branch of the throat portion (30). In the preferred embodiment, each of the studs (36) includes a fastener (37), such as a blind rivet, secured on one of two spaced rivet holes (311) which are formed on an inner side of the metal tube (21) at each branch of the throat portion (30). The fastener (37) is used to press a tubular sleeve (38) tightly against the metal tube (21). Blind rivets are conventional, and as such, the construction and the mounting thereof to the metal tube (21) will not be detailed herein. Other methods, such as welding and the like, may be employed so as to mount the studs (36) firmly to the metal tube (21).

The sealing members (40) are received in the side spaces (24) and are provided adjacent to a respective end of each cut-out portion (31). The sealing members (40) are preferably made of cork or rubber and prevent the leakage of fluid into the side spaces (24), as will be detailed in the succeeding paragraphs.

The bridge portion (50) is formed on the throat portion (30) during an injection molding process. Referring to FIGS. 4 to 7, the bridge portion (50) is made of a fiber-reinforced composite plastic material and extends between the branches of the throat portion (30). The bridge portion (50) and the head portion (20) cooperatively define an oval-shaped, web holding structure when the bridge portion (50) is formed on the metal tube (21).

The metal tube (21) is first provided in a mold when forming the bridge portion (50). Plastic melt is then injected into the mold so as to produce the bridge portion (50). The studs (36) extend into the bridge portion (50) when the latter is formed. Plastic melt enters the cut-out portions (31) so as to form engaging projections (52) which are integral with the bridge portion (50) and which are in tight engagement with the side walls (32, 33). The metal tube (21) is also coated with a plastic coating (53) which is integral with the bridge portion (50) during the molding process. This illustrates how the bridge portion (50) is firmly secured to the metal tube (21).

The engaging projections (52), the studs (36) and the plastic coating (53) strengthen the junction between the bridge portion (50) and the metal tube (21) to prevent damage thereat due to strong impact. The preferred embodiment can thus handle relatively large amounts of forces in different directions without producing any damage at the junction of the bridge portion (50) and the metal tube (21).

Figure 8:
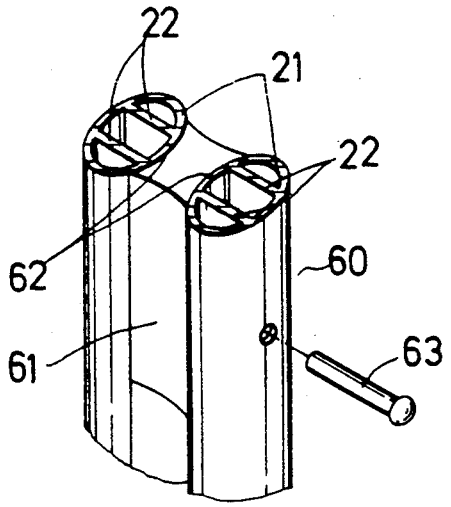
FIG. 8 is a fragmentary view illustrating the assembly of a vibration-absorbing member to the metal racket frame of the present invention.
Figure 9:
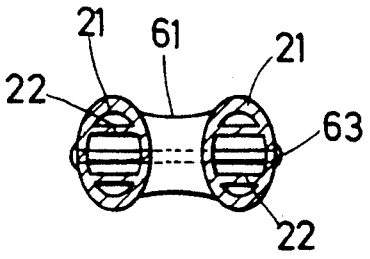
FIG. 9 is a top view of FIG. 8.

Referring once more to FIG. 2, the handle portion (60) is disposed on the throat portion (30). A vibration-absorbing member (61) is provided in a gap defined by the branches of the throat portion (30) at a location adjacent to the handle portion (60). Referring to FIGS. 8 and 9, the vibration-absorbing member (61) is made of a resilient rubber material and has a pair of curved contact surfaces (62) which are in tight pressing contact with the outer surface of the metal tube (21). A rivet (63) is provided to retain the vibration-absorbing member (61) in this position. A grip sleeve (64) is provided on the handle portion (60) and is made from injection molded foam material. The grip sleeve (64) may be provided with decorative marks so as to enhance the aesthetic appeal of the metal racket frame of the present invention.

The vibration-absorbing member (61) can absorb a large portion of the resulting vibrations when a web of strings which is held by the metal racket frame of the present invention is struck. The vibration-absorbing member (61) thus reduces the vibrations felt at the handle portion (60), making the preferred embodiment easier to handle and minimizing the risk of injury due to strong impact.

Figure 10:
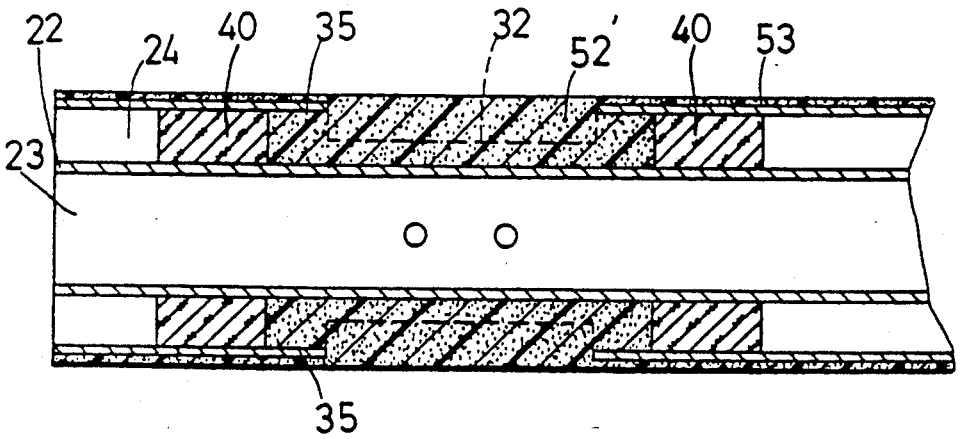
FIG. 10 is a sectional view illustrating another preferred arrangement of a plurality of sealing members of the metal racket frame of the present invention.

Referring to FIG. 10, the sealing members (40) may be inserted further into the side spaces (24) so as to form clearances (35) with the two ends of the cut-out portions (31). The engaging projections (52') which are formed when molding the bridge portion extend into the clearances (35) so as to strengthen the connection between the bridge portion and the metal tube.

Figure 11:
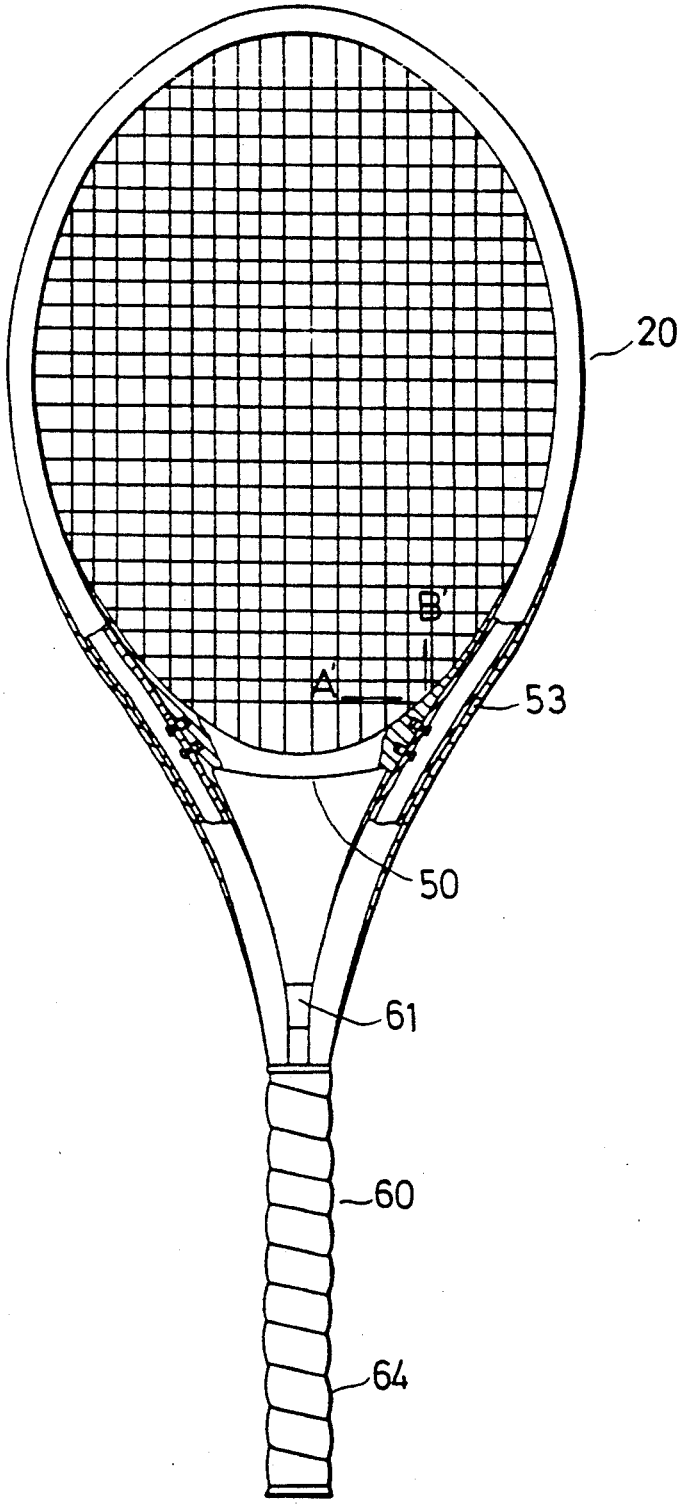
FIG. 11 is an illustration of the preferred embodiment when provided with a web of strings.

FIG. 11 is an illustration of the preferred embodiment when provided with a web of strings. When the web held by the metal racket frame of the present invention is struck, the resulting forces [indicated by the arrows (A') and (B')] tend to pull the bridge portion (50) away from the metal tube (21). The firm engagement of the engaging projections (52) with the metal tube (21) at the cut-out portions (31), however, prevents any movement of the bridge portion (50) relative to the metal tube (21).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A metal racket frame, comprising:

a metal tube including a curved head portion, a converging throat portion which extends from said head portion, a handle portion which extends from said throat portion, a pair of spaced elongated partitions which extend along the length of said metal tube, a central space between said elongated partitions and a side space on each side of said central space; said throat portion having two branches, each of which includes at least one elongated cut-out portion to access one of said side spaces;

a plurality of sealing members, each of which is provided inside one of said side spaces accessed by said cut-out portion adjacent to one end of said cut-out portion;

a bridge portion which extends between said branches of said throat portion and which cooperates with said head portion to define an oval-shaped, web holding structure; and a plastic coating covering said metal tube and having an engaging projection received in each said cut-out portion; said bridge portion, said engaging projection and said plastic coating being made of a fiber-reinforced composite material and being simultaneously and integrally formed in a mold after placing said metal tube therein.

2. The metal racket frame as claimed in claim 1, wherein said sealing members are made of cork.

3. The metal racket frame as claimed in claim 1, wherein said sealing members are made of rubber.

4. The metal racket frame as claimed in claim 1, further comprising a gap, defined by said branches of said throat portion adjacent to said handle portion, and a vibration-absorbing member provided in said gap, said vibration-absorbing member being made of rubber and having a pair of contact surfaces which are in contact with said branches of said throat portion.

5. The metal racket frame as claimed in claim 4, further comprising a rivet means for retaining said vibration-absorbing member between said branches of said throat portion.

6. The metal racket frame as claimed in claim 1, wherein said metal tube further comprises at least one stud provided on said metal tube at said throat portion and extending into bridge portion.

* * * * *